US006783488B1

(12) United States Patent
Shoebridge et al.

(10) Patent No.: US 6,783,488 B1
(45) Date of Patent: Aug. 31, 2004

(54) PAPER FOLDER WITH SWITCHABLE FOLDING APPARATUS

(75) Inventors: Donald T. Shoebridge, Huntington, IN (US); Shanon T. Odman, Wabash, IN (US)

(73) Assignee: Martin Yale Industries, Inc, Wabash, IN (US)

( * ) Notice: Subject to any disclaimer, the term of this patent is extended or adjusted under 35 U.S.C. 154(b) by 0 days.

(21) Appl. No.: 10/409,883

(22) Filed: Apr. 9, 2003

(51) Int. Cl.[7] ..... B31F 1/00

(52) U.S. Cl. ..... 493/420; 493/424; 493/434; 493/442

(58) Field of Search ..... 493/419, 420, 493/424, 434, 442; 270/32

(56) References Cited

U.S. PATENT DOCUMENTS 4,101,121 A * 7/1978 Rastorguyeff ..... 493/37
4,300,896 A * 11/1981 Priebs ..... 493/419
4,944,131 A * 7/1990 Gough ..... 53/117
5,026,035 A * 6/1991 Martinez Sanz et al. ..... 270/45
5,152,738 A * 10/1992 Zehender ..... 493/440
5,697,880 A * 12/1997 Auerbach ..... 493/420
6,050,928 A 4/2000 Tsai
6,453,647 B1 * 9/2002 Adams et al. ..... 53/460

* cited by examiner

*Primary Examiner*—Eugene Kim
(74) *Attorney, Agent, or Firm*—Cardinal Law Group

(57) ABSTRACT

The invention provides a table top folding apparatus that is easily reconfigured to provide a single fold folding apparatus or a multi-fold folding apparatus. The apparatus includes a frame, having first and second roller pairs and a first fold table and a second fold table positioned to receive material from the respective roller pairs. The apparatus also includes a fold selector assembly rotatably attached to the frame, the assembly including a diverter and a stop fence. The fold selector assembly is adjustable by a single actuation arm to rotate between a single fold position and a double fold position. The invention further provides a tabletop folding apparatus having independently adjustable fold selector and material diverter assemblies.

19 Claims, 4 Drawing Sheets

PAPER FOLDER WITH SWITCHABLE FOLDING APPARATUS

TECHNICAL FIELD

The technical field of this invention relates, generally, to material folding devices, and more particularly to, a table to paper folder.

BACKGROUND OF THE INVENTION

Buckle chute folding devices are well known. Folders are used to fold single or multiple sheets of paper or other sheet materials such as metal, cardboard, plastic, or other similar materials that, when folded, will retain a crease. Typically, folders use a series of rollers to grab and move the material being folded through the fold process. These rollers also crease the material as it passes between sets of contacting rollers. In the majority of cases, folders create one or two folds, depending on how the folding device is configured.

Generally, a folding device includes a folding table for each fold desired. The fold table includes a device to block the path of the material to be folded. This blocking device is commonly referred to as a stop. Typically, as the material leaves a set of rollers, it enters into and is loosely contained within the fold table. The stop is positioned within the fold table at a specific distance from the rollers depending on the desired location of the fold. When the material strikes the stop, because the material is contained within the fold table, the only place that the material can buckle is outside of the fold table, near the rollers at the entrance of the fold table. An additional pair of rollers will then capture the material at the buckle and finish the fold by creasing the material as the material passes through the pair of rollers. The position of the fold may be adjusted by changing the relative distance between the stop and the rollers. Additionally, as long as there is a pair of rollers for each fold table that exists in the folder, the material will be folded once.

Many folding devices that are capable of producing multiple folds are designed to be configured to also produce a single fold. However, the problem arises as to how to eliminate the unneeded material pathways within the folding device when only a single fold is desired. Some prior devices eliminate one of the fold tables from the material path. This is generally done by changing the orientation, through reversing, the unneeded fold table, so that the reversed fold table becomes a material path diverter of sorts. Reversing the fold table is often burdensome and, for large folding devices, can be quite bulky and awkward due to the weight of the fold table. Furthermore, to complete the reconfiguration, the position of the stop in the remaining fold table must be adjusted in order to obtain the desired fold position. Thus, folding devices that allow for varying the number of folds require multiple steps to change configurations. This is often time consuming and requires a degree of user experience to configure the folder from a multiple fold to a single fold, and back again.

Therefore, it would be desirable to have a material folder with a user adjustable mechanism that overcomes these and other disadvantages.

SUMMARY OF THE INVENTION

The present invention provides a tabletop apparatus for folding material. The apparatus includes a frame, having first and second roller pairs and a first fold table and a second fold table positioned to receive material from the respective roller pairs. The apparatus also includes a fold selector assembly rotatably attached to the frame, the assembly including a diverter and a stop fence. The fold selector assembly is adjustable by a single actuation arm to rotate between a single fold position and a double fold position. The invention further provides a tabletop folding apparatus having independently adjustable fold selector and material diverter assemblies.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

DESCRIPTION OF THE PRESENTLY PREFERRED EMBODIMENT

Figure 1:
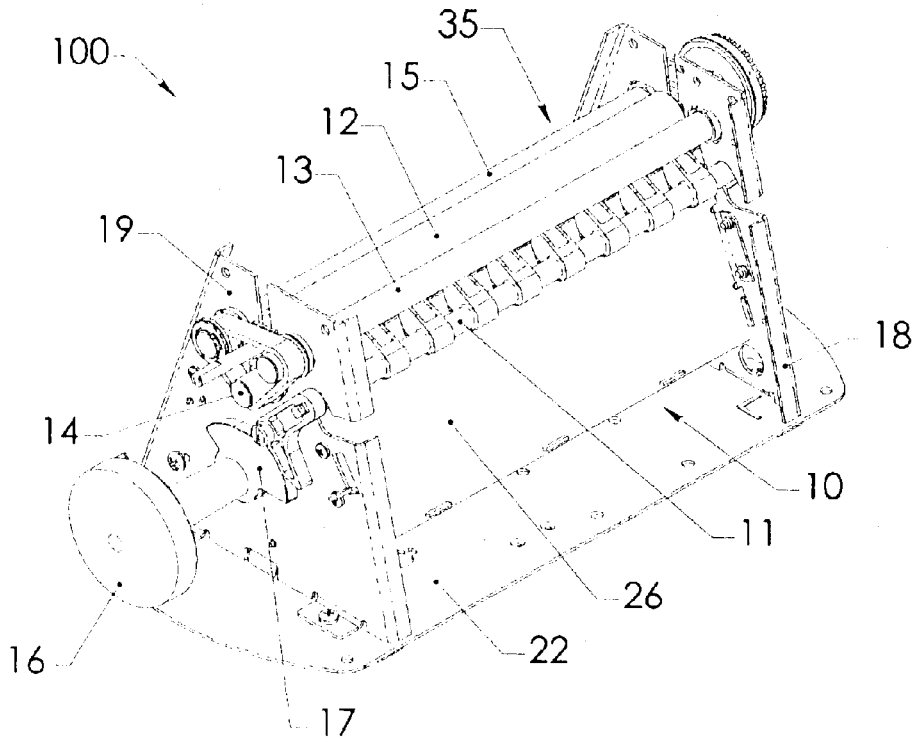
FIG. 1 illustrates a perspective view of one embodiment of a material folder made in accordance with the present invention.
Figure 2:
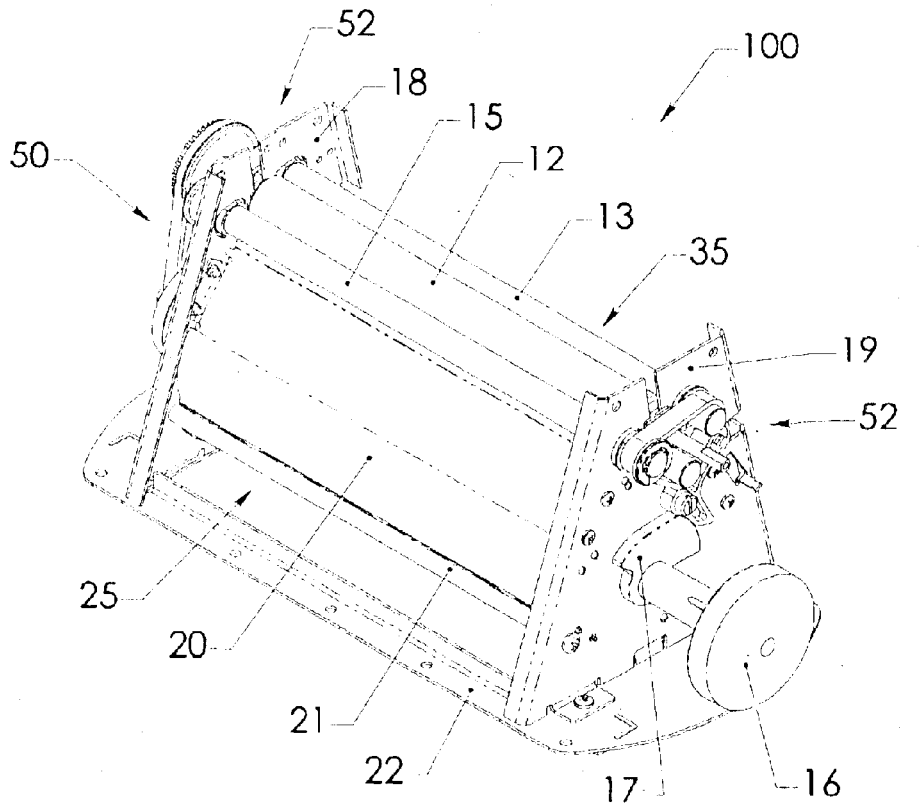
FIG. 2 illustrates a reverse perspective view of the folder illustrated in FIG. 1 and made in accordance with the present invention.
Figure 3:
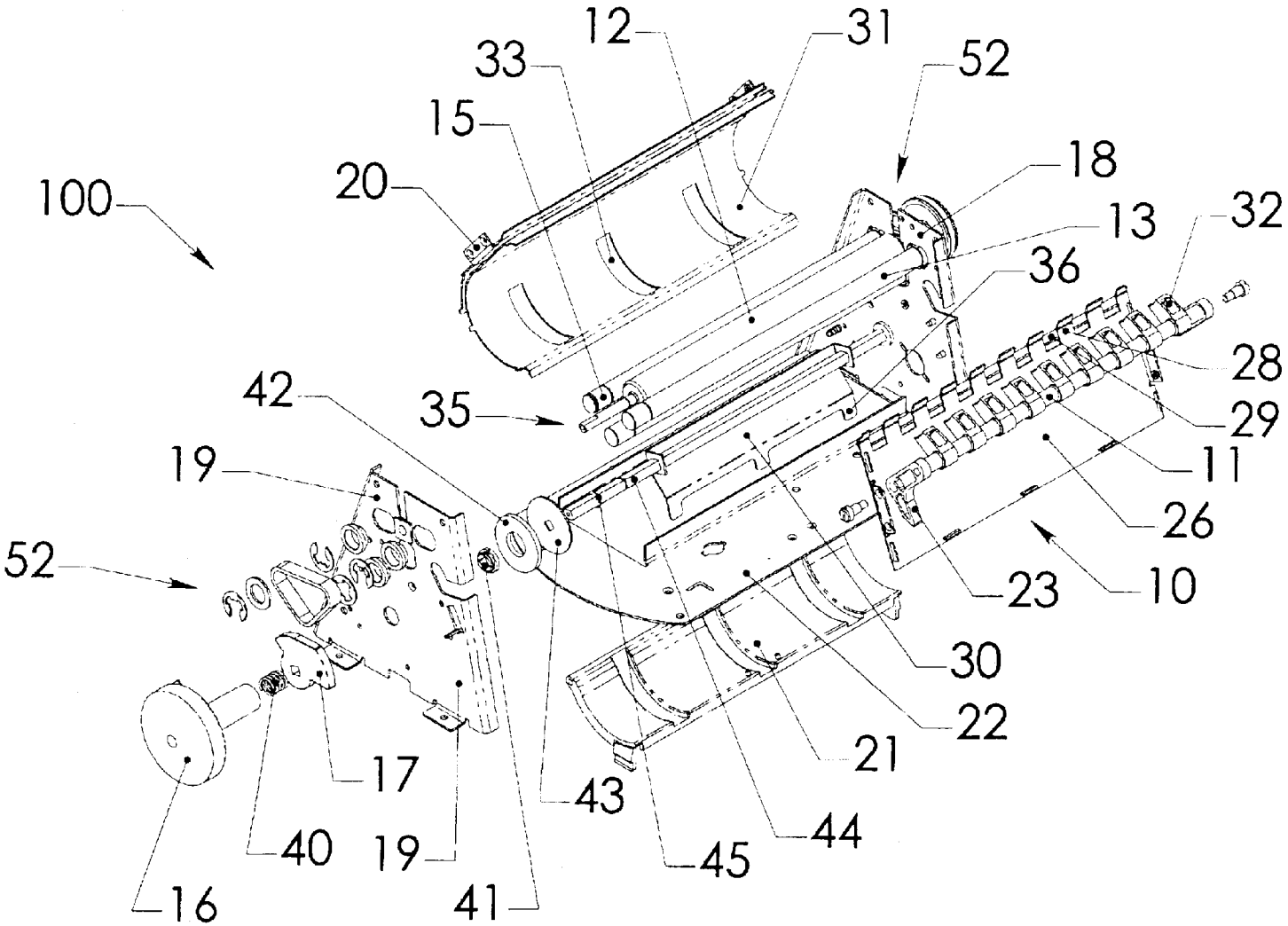
FIG. 3 illustrates an exploded isometric view of the folder illustrated in FIG. 1 and made in accordance with the present invention.

FIGS. 1 to 4B illustrates a folding device 100 that is reconfigurable through a single adjustment knob. In one embodiment, folding device 100 is utilized for folding paper products. In other embodiments, the folding device may be used to fold materials such as, for example, metal, cardboard, plastic, or other similar materials. For simplicity, the folding device described herein will be illustrated using paper and may be referred to, alternatively, as a paper folder. FIGS. 1 to 4B illustrate a paper folding device 100 allowing a single point adjustment to change the configuration from a single fold device to a double fold device and back again.

Paper folder 100 includes a frame having a base 22, a motor side plate 18 and a non-motor side plate 19 that, together, fixedly capture the following assemblies: a first fold table assembly 10, a second fold table assembly 25 and a roller assembly 35. Paper folder 100 further includes motor assembly 50 and belt tension/drive assembly 52 previously described in U.S. patent application Ser. No. 10/115,784, filed Apr. 4, 2002 titled "Belt Tension/Drive For Pinch Roller System" by Charles W. Reed, the entirety of which is incorporated by reference. Motor assembly 50 is operably attached to belt tension/drive assembly 52.

First fold table assembly 10 includes first fold table outer plate 26, first fold table inner plate 27, and first fold table stop 24. In the embodiment illustrated in FIGS. 1 to 4B, stop 24 is a fixed position stop. In another embodiment, the stop associated with the first fold table may be adjustable, as is well known in the art. First fold table outer plate 26 includes a plurality of notches 29 defined in the upper portion 28 of the first fold table outer plate 26. The notches 29 are fashioned to allow operation of the diverter 11, discussed in more detail below.

Second fold table assembly 25 includes second fold table outer plate 20, second fold table inner plate 31, and de-jam panel 21. Second fold table inner plate 31, includes a plurality of openings 33. Openings 33 provide clearance through which stop fence 30 (discussed below) blocks the material pathway formed between the second fold table outer plate 20, second fold table inner plate 31. De-jam panel 21 is removably attached to paper folding device 100 to facilitate easy removal of paper jams. The embodiment of the present invention illustrated includes a second fold table assembly 25 having a curved portion. The curved design of the second fold table assembly 25 is such that the center of the radius that makes up the curve passes directly through the center of rotation of the stop fence shaft 44, and the stop fence 30, discussed below. This insures that the stop fence 30 is perpendicular to the paper path. Those skilled in the art will recognize that second fold table assembly 25 may have various other configurations such as, for example, straight, flat, or the like.

Roller assembly 35 is rotatably mounted between the motor side plate 18 and a non-motor side plate 19. Roller assembly 35 includes capstan roller 12, first pinch roller 13, second pinch roller 14, and third pinch roller 15. Roller assembly 35 is operably connected to belt tension/drive assembly 52. The four rollers are arranged to form three roller pairs. The arrangement of roller assembly 35 has been previously described in U.S. patent application Ser. No. 10/1 15,784, filed Apr. 4, 2002 and titled "Belt Tension/Drive For Pinch Roller System" by Charles W. Reed, the entirety of which is incorporated by reference. Those skilled in the art will recognize that various other roller arrangements may be employed without departing from the spirit and scope of the present invention.

First fold table assembly 10 is positioned to receive material passed through the first roller pair formed from capstan roller 12 and pinch roller 13. Second fold table assembly 25 is positioned to receive material passed through the second roller pair formed from capstan roller 12 and pinch roller 14.

Paper folding device 100 further includes a fold selector assembly including a diverter 11 (discussed below) and a stop fence assembly 34. Stop fence assembly 34 includes stop fence 30, selector shaft 44, and cam 17. Attached to the selector shaft 44 are e-clip 45, clutch plate 43, polyurethane disk 42, cam 17, compression spring 40, stop fence 30, and adjustment device 16. Selector shaft 44 rides within synthetic bearings 41. As mentioned above, the second fold table assembly shares a common center axis with the rotation axis of the adjustment knob and, consequently, the rotation axis of the stop fence. The curved nature of the second fold table and the common axis ensures that the surface on which the paper makes contact as it stops in the second fold table is perpendicular to the incoming paper, and is collinear to the axis of rotation of the adjustment knob. Additionally, regardless of the position to which the paper stop fence 30 is adjusted, the incoming paper will make contact with the surface of the paper stop perpendicular to the direction of travel.

Figure 4A:
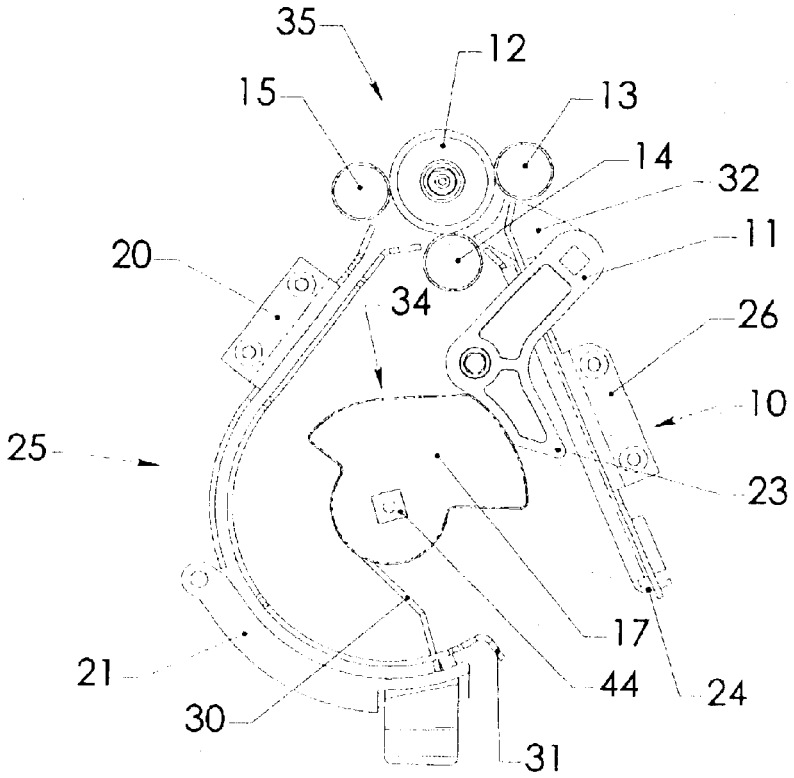
FIGS. 4A and 4B illustrate one end view of the folder illustrated in FIG. 1 with an adjustment knob in the extreme maximum and minimum positions, respectively.
Figure 4B:
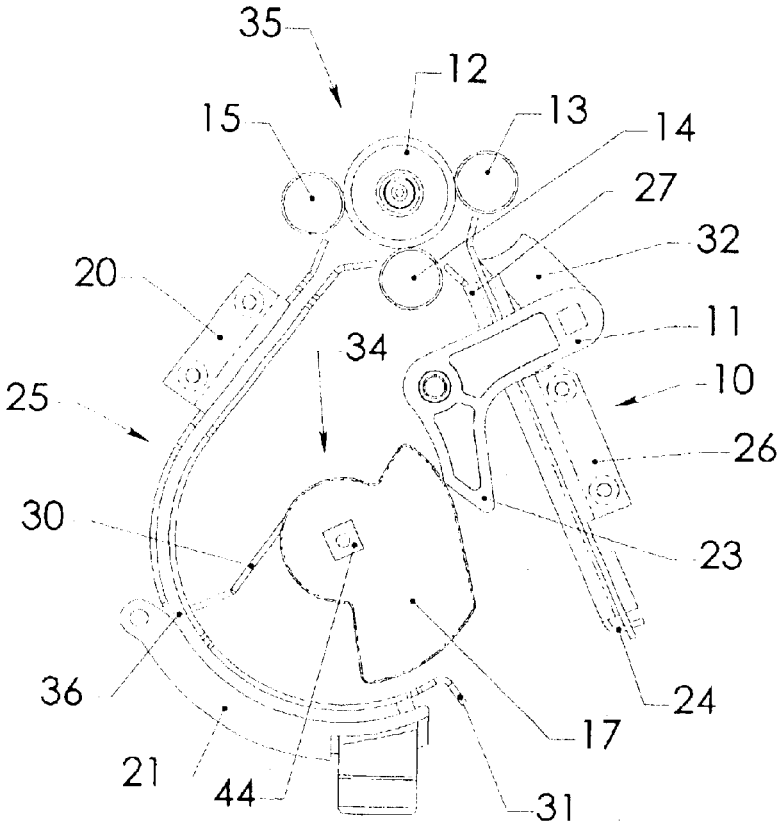

In the embodiment illustrated in FIGS. 4A and 4B, adjustment knob 16 may be actuated to move the stop fence between one of two positions depending on whether a single fold or a double fold is desired. FIG. 4A shows the stop fence in the right (counter-clockwise) position, used when the paper folder is configured to perform a single fold. FIG. 4B shows the stop fence in the left (clockwise) position, used when the paper folder is configured to perform a double fold. In the embodiment illustrated in FIGS. 1 to 3, the adjustment device 16 is shown as a knob. Those skilled in the art will appreciate that adjustment device 16, may take other forms such as, for example, a lever, handle, switch, bar, button, or the like. Further, it is contemplated that the adjustment device 16 may be actuated manually, mechanically or electrically.

In one embodiment, stop fence 30 includes a plurality of tab portions 36. Tab portions 36 function to block the paper pathway within the second fold table assembly 25. Tab portions 36 are-sized to move freely within openings 33 of second fold table inner plate 31. Those skilled in the art will recognize that the number of tab portions 36 and openings 33 may vary depending on the specific application of the folding device. Those skilled in the art will also recognize that stop fence 30 and second fold table assembly 25 may be configured such that stop fence 30 blocks the entire material pathway along the width of the fold table.

Paper folding device 100 further includes diverter 11. Diverter 11 is attached to the outer faces of the motor side plate 18 and the non-motor side plate 19. Diverter 11 includes actuation arm 23 that is operably connected to cam 17 of selector assembly 34. The connection between the actuation arm 23 and the cam 17 allows an operator to adjust the position of the paper diverter 11 and the position of stop fence 30 with one turn of adjustment knob 16 thereby simplifying the reconfiguration of the paper folder.

Diverter 11 further includes a plurality of fingers 32 positioned along the length of the diverter. Rotation of the diverter rotates the diverter fingers into and out of the material pathway that leads to the first fold table 10 depending on the desired fold. Those skilled in the art will recognize that the number and position of the diverter fingers may vary depending on the application of the folding device. Those skilled in the art will appreciate that the present invention contemplates other mechanisms for diverter actuation, such as, for example, an electric solenoid, motor, lever, knob, handle, bar, button, or the like.

The present embodiment is configured such that stop fence 30 is locked into place during the folding process. Stop fence 30 is locked into position by friction via the polyurethane disk 42 and the clutch plate 43. Clutch plate 43 is keyed to the stop fence shaft 44, and will rotate as the adjustment knob 16 is rotated. However, the stop fence shaft 44 is free to slide through clutch plate 43. The compression spring 40 provides the necessary force to squeeze the polyurethane disk 42 between the clutch plate 43 and the non-motor side plate 19. This force is transmitted from the compression spring 40, to the adjustment knob 16, which is held to the end of the stop fence shaft 44 by a screw (not shown), and finally to the e-clip 45 which applies this force to the clutch plate 43, opposite of the polyurethane disk 42. The clutching/locking mechanism presented illustrates one example of the means to fixedly hold the stop fence in place, those skilled in the art will appreciate that other mechanisms, such as a tapered collet, multi disk clutch pack, locking pins, disks, bands, or the like, can be used without departing from the spirit of the invention.

However, to reconfigure the paper folder from a single (half) fold to a tri-fold (double fold), or visa versa, or to adjust where the fold occurs on the paper, rotation of the adjustment knob 16 is required by the operator. This requires that the polyurethane disk 42 and the clutch plate 43 be separated from each other. This is done by applying pressure axially on the adjustment knob 16 until the polyurethane disk 42 and the clutch plate 43 become separated, effectively unlocking the stop fence 30. As long as the operator maintains the axial pressure on the adjustment knob 16, the stop fence 30 and the adjustment knob 16 are free to rotate. Rotation of the adjustment knob 16 can also be achieved by applying sufficient rotational force to the adjustment knob 16 without applying axial pressure, thereby forcibly overcoming the friction between the polyurethane disk 42 and the clutch plate 43, the non-motor side plate 19, or both.

In the embodiment of paper folder 100 illustrated in FIGS. 1 to 4B, the folder is configured to receive paper limited to letter size (8 ½"×11") and A4. In another embodiment, the paper folder can accommodate other paper sizes well known in the art.

In operation, for the folder to perform a single (half) fold, only one fold table is required. Therefore, for the paper folder to perform a single fold, the paper must bypass the first fold table assembly 10. In the embodiment illustrated in FIG. 4A, the first fold table assembly 10 is bypassed through the use of diverter 11, which is actuated by cam 17. The cam 17 rides on the selector shaft 44. Similarly to the clutch plate 43, cam 17 is keyed to the selector shaft 44 but is allowed to slide along its length. As the adjustment knob 16 is rotated to the right (counter-clockwise) position, cam 17 also rotates thereby rotating the diverter 11 and placing the diverter fingers 32 through notches 29 and into the material pathway. The diverter fingers 32 block the pathway into the first fold table. Furthermore, since the location at which the fold will occur in the paper is different than either one of the two folds in a double fold, the location of the stop fence 30 must also be changed in order to correctly perform a single fold. In the present embodiment, this is automatically accomplished when the adjustment knob 16 is rotated to the right (counter-clockwise) position. FIG. 4A shows the diverter 11 being actuated by cam 17, blocking the paper path, and keeping the paper from entering the first fold table assembly 10. With the diverter 11 engaged, this essentially causes the second fold table assembly 25 to become a first fold table.

When the folder is configured for a single (half) fold as shown in FIG. 4A, the paper path begins with paper entering from the top of the folder where the capstan roller 12 and the first pinch roller 13 touch. As the capstan roller 12 rotates in a clockwise direction, the remaining pinch rollers rotate in a counter-clockwise direction. As the paper exits the contact point or nip of the capstan roller 12 and the first pinch roller 13, theleading edge of the paper is redirected by diverter fingers 32 toward the nip of capstan roller 12 and second pinch roller 14. Continued rotation of the capstan roller 12, first pinch roller 13, and second pinch roller 14 will transport the paper into the gap created by the second fold table inner plate 31 and the combination of the second fold table outer plate 20 and the de-jam panel 21. Once the leading edge of the paper reaches the stop fence 30, the paper will buckle at the point where the paper first entered the second fold table assembly 25. Because the paper must change direction to enter the second fold table assembly 25, this urges the paper to buckle in the proper direction, toward the capstan roller 12 and the third pinch roller 15. Because the capstan roller 12 is made of a material and in a manner that promotes a high coefficient of friction, the paper is gripped by the capstan roller 12 and pulled into the nip between capstan roller 12 and the third pinch roller 15, creasing the paper. The paper then exits the folder vertically from between the capstan roller 12 and the third pinch roller 15.

FIG. 4B illustrates the paper folder in a configuration to perform a double fold (tri-fold). FIG. 4B shows the diverter 11 disengaged, thereby clearing the paper path and allowing the paper to enter the first fold table assembly 10.

For the folder to perform a tri-fold, two fold tables are required, one for each fold that the paper will receive. The paper path for a tri-fold as shown in FIG. 4B begins exactly as the single (half) fold configuration, discussed above in reference to FIG. 4A, with paper entering from the top of the folder where the capstan roller 12 and the first pinch roller 13 touch. However, as the paper exits the nip of the capstan roller 12 and the first pinch roller 13, the leading edge of the paper enters and travels down the length of the first fold table assembly 10, until the leading edge of the paper bottoms-out against stop 24. When this occurs, the paper will buckle at the point where the paper first entered the first fold table assembly 10. Because the paper must change direction to enter the first fold table assembly 10, the paper will buckle in the proper direction, toward the capstan roller 12 and the second pinch roller 14. As mentioned above, because the capstan roller 12 is made of a material and in a manner that promotes a high coefficient of friction, the paper is gripped by the capstan roller 12 and pulled into where the capstan roller 12 and the second pinch roller 14 make contact with each other, creasing the paper. The once folded paper will then enter the second fold table assembly 25 to complete the second fold. The remainder of the paper path is exactly the same as the paper path with the folder configured for a single (half) fold, with only one exception, the location of the stop fence 30. As shown in FIG. 4B, the adjustment knob 16 has been rotated left (clockwise) to position the stop (tab) 36 closer to the entrance to the second fold table assembly. This change in position will cause the location of the fold on paper entering the second fold table.

Figure 5A:
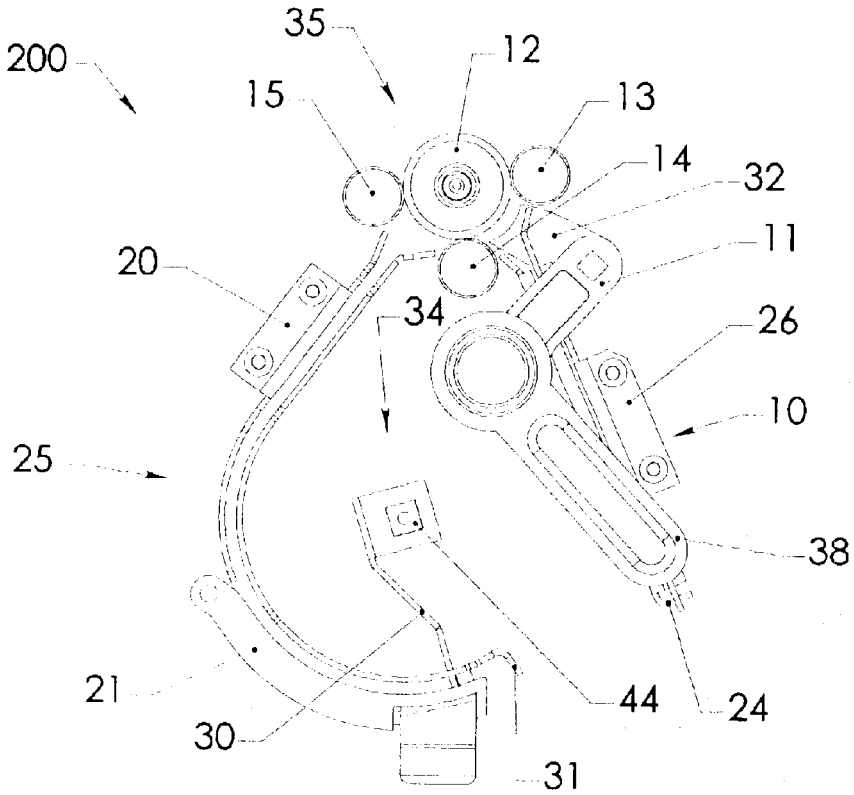
FIGS. 5A and 5B illustrate another embodiment of a material folder made in accordance with the present invention.
Figure 5B:
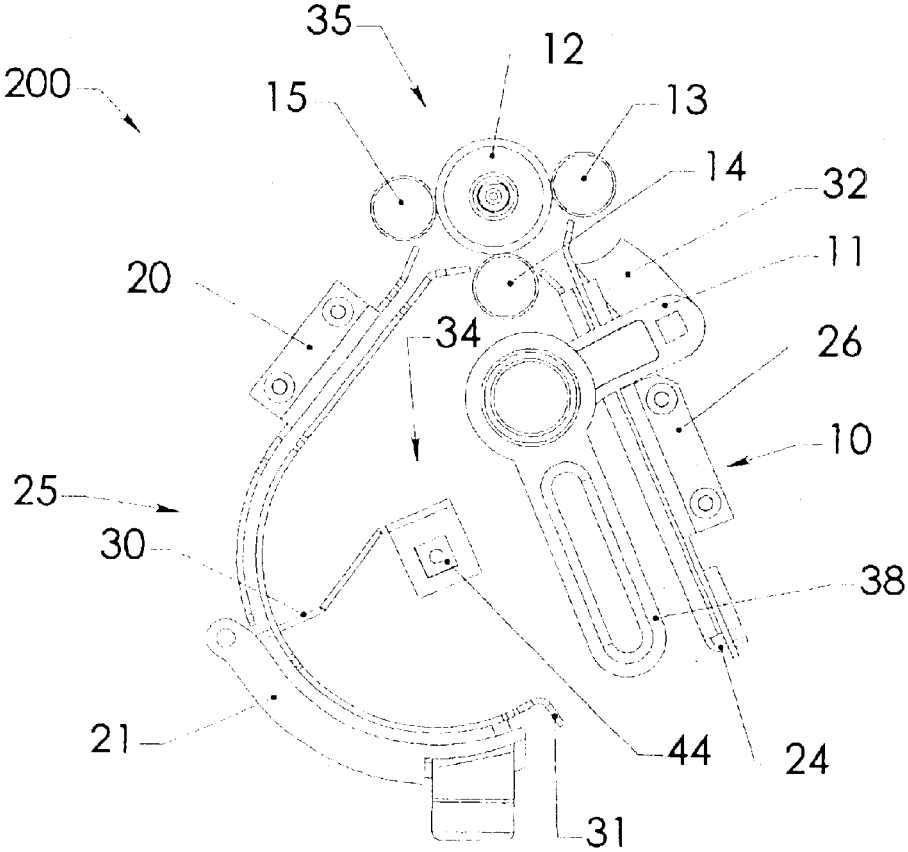

FIGS. 5A and 5B illustrate another embodiment of a material folding device made in accordance with the present invention, shown generally as 200, where like elements have like reference numbers as those illustrated in FIGS. 1 to 4B. In the embodiment illustrated in FIGS. 5A and 5B, diverter 11 and stop fence 30 may be actuated independently. In this embodiment, diverter 11 includes adjustment lever 38. Turning adjustment lever 38 to the left or right moves the diverter fingers 32 in and out of the material pathway leading to the first fold table. Also in this embodiment, another adjustment device (not shown) is attached to selector shaft 44 in order to move the stop fence 30 into or out of the material pathway. This configuration provides for a stop fence 30 that is infinitely variable allowing a fold to be placed in a variety of positions depending on the desired output.

In yet another embodiment, (not shown) a diverter may be employed to bypass the second fold table assembly instead of the first fold table assembly. This diverter may be configured to block the paper pathway into either the first fold table or the second fold table. In still another embodiment, each of the fold tables may have an associated diverter dedicated to blocking the single material pathway.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A tabletop material folding apparatus comprising:

a frame;

first and second roller pairs operably attached to the frame;

a first fold table positioned to receive material passed through the first roller pair;

second fold table positioned to receive material passed through the second roller pair; and a fold selector assembly rotatably attached to the frame, the fold selector assembly including a diverter and a stop fence, wherein the fold selector assembly is rotatable between a single fold position and a double fold position, wherein when the fold selector assembly is rotated to the single fold position the diverter is positioned to divert material passing through the first roller pair into the second roller pair and the stop fence is positioned at a first fold position of the second material fold table, and when the fold selector assembly is rotated to a double fold position the diverter is positioned to allow material into the first fold table and the stop fence is positioned in a second fold position of the second fold table, wherein the fold selector assembly includes a selector shaft including a cam, the diverter including a plurality of diverter fingers and a diverter arm, the stop fence attached to the selector shaft, wherein rotation of the selector shaft positions the stop fence and simultaneously interfaces the cam with the diverter arm to position the plurality of diverter fingers between the first fold position and the second fold position.

2. The apparatus of claim 1 further comprising:

an adjustment device operably attached to the selector shaft.

3. The apparatus of claim 2 wherein the adjustment device is selected from a group consisting of a knob, a lever, a handle, a switch, a bar, or a button.

4. The apparatus of claim 2 wherein the adjustment device is actuated by a method chosen from a group consisting of manual actuation, electrical actuation or mechanical actuation.

5. The apparatus of claim 1 wherein the second fold table defines a second material pathway and comprises an inner plate, an outer plate and a de-jam plate, the inner plate defining a plurality of openings.

6. The apparatus of claim 5 wherein the second material pathway includes a curved portion having a radius with a center that corresponds to an axis of rotation of the selector shaft.

7. The apparatus of claim 1 wherein the stop fence includes a plurality of tabs that extend through the openings of the inner plate of the second fold table to block the material pathway defined by the second fold table.

8. A tabletop material folding apparatus comprising:

a frame;

first and second roller pairs operably attached to the frame;

first material fold table positioned to receive material passed through the first roller pair;

a second material fold table positioned to receive material passed through the second roller pair;

a diverter shaft rotatably attached to the frame, wherein the diverter shaft is rotatable between a single fold position and a double fold position, wherein when the diverter shaft is rotated to the single fold position the diverter shaft is positioned to divert material passing through the first roller pair into the second roller pair and when the diverter shaft is rotated to a double fold position the diverter is positioned to allow material into the first fold table; and a selector shaft operably engageable with the diverter shaft, wherein the selector shaft includes a selector cam, the diverter shaft including a diverter and a diverter arm, a stop fence attached to the selector shaft, wherein rotation of the selector shaft positions the stop fence and simultaneously interfaces the cam with the diverter arm to position the diverter between the single fold position and the double fold position.

9. The apparatus of claim 8 further comprising:

an adjustment device operably attached to the selector shaft.

10. The apparatus of claim 9 wherein the adjustment device is selected from a group consisting of a knob, a lever, a handle, a switch, a bar, or a button.

11. The apparatus of claim 9 wherein the adjustment device is actuated by a method chosen from a group consisting of manual actuation, electrical actuation or mechanical actuation.

12. The apparatus of claim 8 wherein the second fold table defines a second material pathway and comprises an inner plate, an outer plate and a de-jam plate, the inner plate defining a plurality of openings.

13. The apparatus of claim 12 wherein the second material pathway includes a curved portion having a radius with a center that corresponds to an axis of rotation of the top fence shaft.

14. The apparatus of claim 12 wherein the stop fence includes a plurality of tabs that extend through the openings of the inner plate of the second fold table to block the material pathway defined by the second told table.

15. A tabletop material folding apparatus comprising:

a frame;

first and second roller pairs operably attached to the frame;

a first material fold table positioned to receive material passed through the first roller pair;

a second material fold table positioned to receive material passed through the second roller pair;

a diverter shaft rotatably attached to the frame, wherein the diverter shaft is rotatable between a single fold position and a double fold position, wherein when the diverter shaft is rotated to the single fold position the diverter shaft is positioned to divert material passing through the first roller pair into the second roller pair and when the diverter shaft is rotated to a double fold position the diverter is positioned to allow material into the first fold table;

a selector shaft; and a stop fence attached to the selector shaft, the diverter shaft including a diverter and a diverter arm, wherein rotation of the selector shaft positions the stop fence between a first fold position and second fold position.

16. The apparatus of claim 15 further comprising:

a first adjustment device operably attached to the selector shaft; and a second adjustment device operably attached to the diverter shaft.

17. The apparatus of claim 15 wherein the first and second adjustment devices are selected from a group consisting of a knob, a lever, a handle, a switch, a bar, or a button.

18. The apparatus of claim 16 wherein the first and second adjustment devices are actuated by a method chosen from a group consisting of manual actuation, electrical actuation or mechanical actuation.

19. A tabletop material folding apparatus comprising:

a frame;

first and second roller pairs operably attached to the frame;

a first fold table positioned to receive material passed through the first roller pair;

a second fold table positioned to receive material passed through the second roller pair;

means for diverting the material from entering the first fold table;

means for stopping the advancement of the material within the second fold table;

means for simultaneously adjusting the diverting means and the stopping means.

* * * * *